US007775675B2

(12) United States Patent
Hamm

(10) Patent No.: US 7,775,675 B2
(45) Date of Patent: Aug. 17, 2010

(54) EYEGLASSES CASE

(76) Inventor: Steven Wayne Hamm, 2094 N.E. Norrland Ct., Poulsbo, WA (US) 98370

( * ) Notice: Subject to any disclaimer, the term of this patent is extended or adjusted under 35 U.S.C. 154(b) by 242 days.

(21) Appl. No.: 11/973,581

(22) Filed: Oct. 9, 2007

(65) Prior Publication Data

US 2008/0083627 A1 Apr. 10, 2008

Related U.S. Application Data

(60) Provisional application No. 60/850,702, filed on Oct. 10, 2006, provisional application No. 60/897,962, filed on Jan. 29, 2007, provisional application No. 60/965,805, filed on Aug. 21, 2007.

(51) Int. Cl.
*F21V 33/00* (2006.01)
*F21V 23/04* (2006.01)

(52) U.S. Cl. ..... 362/154; 362/253; 362/276

(58) Field of Classification Search ..... 362/253, 362/154–156, 86, 276, 394, 295, 411; 206/5, 206/6

See application file for complete search history.

(56) References Cited

U.S. PATENT DOCUMENTS 6,561,672 B2 * 5/2003 Lessard ..... 362/234
6,851,552 B1 * 2/2005 Chao ..... 206/5
6,857,518 B2 * 2/2005 Chao ..... 206/5
7,063,437 B2 * 6/2006 Taddeo et al. ..... 362/156
7,158,649 B2 * 1/2007 Garber et al. ..... 381/322
7,204,614 B2 * 4/2007 Hanis et al. ..... 362/276
2003/0043578 A1 * 3/2003 Lessard ..... 362/234
2006/0007674 A1 * 1/2006 Taddeo et al. ..... 362/156

* cited by examiner

*Primary Examiner*—Bao Q Truong
(74) *Attorney, Agent, or Firm*—Anthony Claiborne

(57) ABSTRACT

A container having a compartment for retaining personal objects such as eyeglasses comprises a transducer which activates the container in response to a specified user action in proximity to the container. In some embodiments, the transducer is a motion detector and is activated in response to user motion. In other embodiments, the transducer comprises a speech recognition module and is activated in response to the user's voicing a specified utterance. Some embodiments become illuminated upon activation. Some embodiments produce a sound upon activation, enabling the user to locate the container. Some embodiments have a normally closed lid which opens upon activation. Some lidded embodiments are normally locked and become unlocked upon activation. Some embodiments of the container further normally provide low level lighting, thereby enabling the container to serve as a night light. Some embodiments further provide for an individual clean tissue prior to each time an object is placed in the case, to assure cleanliness of the container for each use when it is used by multiple users in a location accessible to the public, such as places of business serving the public where removing eyeglasses is common.

9 Claims, 7 Drawing Sheets

EYEGLASSES CASE

CROSS-REFERENCE TO RELATED APPLICATION

This application claims the benefit under Title 35, United States Code, Section 119(e) of provisional U.S. application No. 60/850,702, filed Oct. 10, 2006, entitled MOTION ACTIVATED LIGHTED EYEGLASSES CASE, and provisional U.S. application No. 60/897,962, filed Jan. 29, 2007, entitled LIDLESS MOTION ACTIVATED LIGHTED EYEGLASSES CASE and provisional U.S. application No. 60/965,805, filed Aug. 21, 2007, entitled EYEGLASSES CASE.

BACKGROUND OF THE INVENTION

1. Field of the Invention

This invention relates to a container configured to hold personal objects, such as eyeglasses. More particularly, this invention relates to such a container having motion-activated illumination and access, also enabled for speech related technologies. This invention also or alternatively relates to such a container having individually dispensed tissues for hygienic purposes when the container is used by multiple users.

2. Description of the Related Art

Various devices are known to provide the utility of storing eyeglasses during periods in which they are not in use. For example, in U.S. Pat. No. 6,102,346, Visser provides such an eyeglass holder. Of particular utility are such devices for storing eyeglasses at bedside. Such utility is enhanced for nighttime use when the device is combined with illumination. In U.S. Pat. No. 4,584,633 and U.S. Pat. No. 4,722,038, Comfort provides a combination night light/eyeglasses holder, in which a night light remains illuminated so long as eyeglasses are contained within the holder. Such devices, however, function as normally illuminated night lights, and are therefore inappropriate in applications in which a night light is not desired.

In applications in which a normally illuminated night light is not desired, it is desirable that an eyeglass holder be illuminated only when the wearer seeks the eyeglasses. In U.S. Pat. No. 6,561,672, Lessard discloses a holder with sound activated illumination for finding objects in the dark. While Lessard mentions voice activation and control of other devices, Lessard's holder, however, simply produces illumination of the holder upon the detection of any sound.

U.S. provisional patent application Ser. No. 60/850,702, filed Oct. 10, 2006 by the inventor of the present invention, discloses an eyeglasses holder as a closeable compartment. That application teaches a container having a closeable compartment for retaining personal objects such as eyeglasses provides a motion sensor coupled to a light source and a motorized opening and closing mechanism, whereby, when a hand reaching toward the container approaches a convenient distance, responsive to a signal from the motion sensor, the compartment is automatically opened and illuminated. With that invention, the user is able to cause a normally closed unlit eyeglasses holder to open and become illuminated responsive to action of the user and thereby allow the user to locate the eyeglasses, without, however, requiring the user to produce an audible sound.

It is often desirable, however, for the user to be able to locate the container without a need for initially reaching in the proximity of the container. For example, if the user awakens in a darkened room and does not know even the approximate whereabouts of the glasses container, it would be desirable for the user to be able to make an initial determination of the location of the container by calling out for it, along the lines of devices described in Lessard's '672 patent. However, Lessard's devices simply respond to noises above a certain threshold amplitude, without discrimination. Accordingly, such devices may be erroneously activated by ambient noises in a sleeper's room, disturbing the sleeper. What is desirable is such a device that activates only upon request of the user and that does not erroneously activate in response to other noises.

When a container is used by multiple users for the storage of their eyeglasses, as in a place of business where users often remove their glasses (such as a beauty salon, a doctor's office, a hotel room, etc.), users face the prospect of contamination of their eyeglasses with oil, dirt, hair and other debris left by prior users of the case. For cases in such public use, it is desirable that the container provide a hygienic utility minimizing such contamination. Further, if the container itself is publicly accessible, it may be desirable for a user to be able to lock his or her personal object within the container, securing it against opening by other parties.

It is an object of the present invention to provide a container for eyeglasses or other personal objects that enables the user to locate the container in a darkened room by simple voice command.

It is a further object of the present invention to provide a hygienic container for situations in which there are multiple users of the invention.

It is a further object of this invention to provide a locking container in which a user may secure his or her personal objects.

BRIEF DESCRIPTION OF THE INVENTION

The present invention is a container having a compartment for retaining personal objects such as eyeglasses. The container further comprises a controller coupled to a transducer, whereby when the controller receives a signal from the transducer, the controller causes the container to operate so as to enable the user to locate the container and access to the compartment so that the user may deposit or retrieve personal objects. The transducer may be a proximity detector, whereby the operation of the container is triggered by the user's reaching in the container's general direction. Alternatively or in addition, the transducer may be a voice recognition module, whereby the operation of the container is triggered by the user's uttering a specified phrase. In some embodiments, the controller is coupled to a light source, whereby when the controller receives the signal from the transducer, the controller directs the light source to illuminate the compartment. With the compartment thus illuminated, the user may easily locate the compartment in a darkened room for depositing or retrieving personal objects within the compartment. The container may in addition or alternatively make an audible sound responsive to the controller. In some embodiments providing illumination, after a short period following the signal from the transducer, the illumination of the compartment is automatically diminished or extinguished. Some embodiments provide a normally closed hinged lid for the compartment, the lid fitted with a motorized opening and closing mechanism that is further coupled to the controller, whereby the signal from the transducer will, in addition to causing illumination of the compartment, cause the lid to open for placement or retrieval of an object. In some such embodiments with a voice recognition module transducer, the container locks securely when closed and is unlocked only upon recognition of the user's utterance of the selected phrase. In embodiments providing a lid, some may provide that the lid will automatically close at the same time that lighting is diminished or extinguished after a short period following the signal from the transducer, while embodiments with voice recognition module transducers may alternatively or in addition close upon a specific spoken utterance by the user. Some embodiments of the container further normally provide low level lighting, thereby enabling the container to serve as a night light.

Some embodiments further provide for an individual clean tissue to be automatically inserted to line the interior of the container prior to each time an object is placed in the case, to assure cleanliness of the container for each use when it is used by multiple users in a location accessible to the public, such as places of business serving the public where removing eyeglasses is common.

BRIEF DESCRIPTION OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE PREFERRED EMBODIMENTS

Figure 1A:
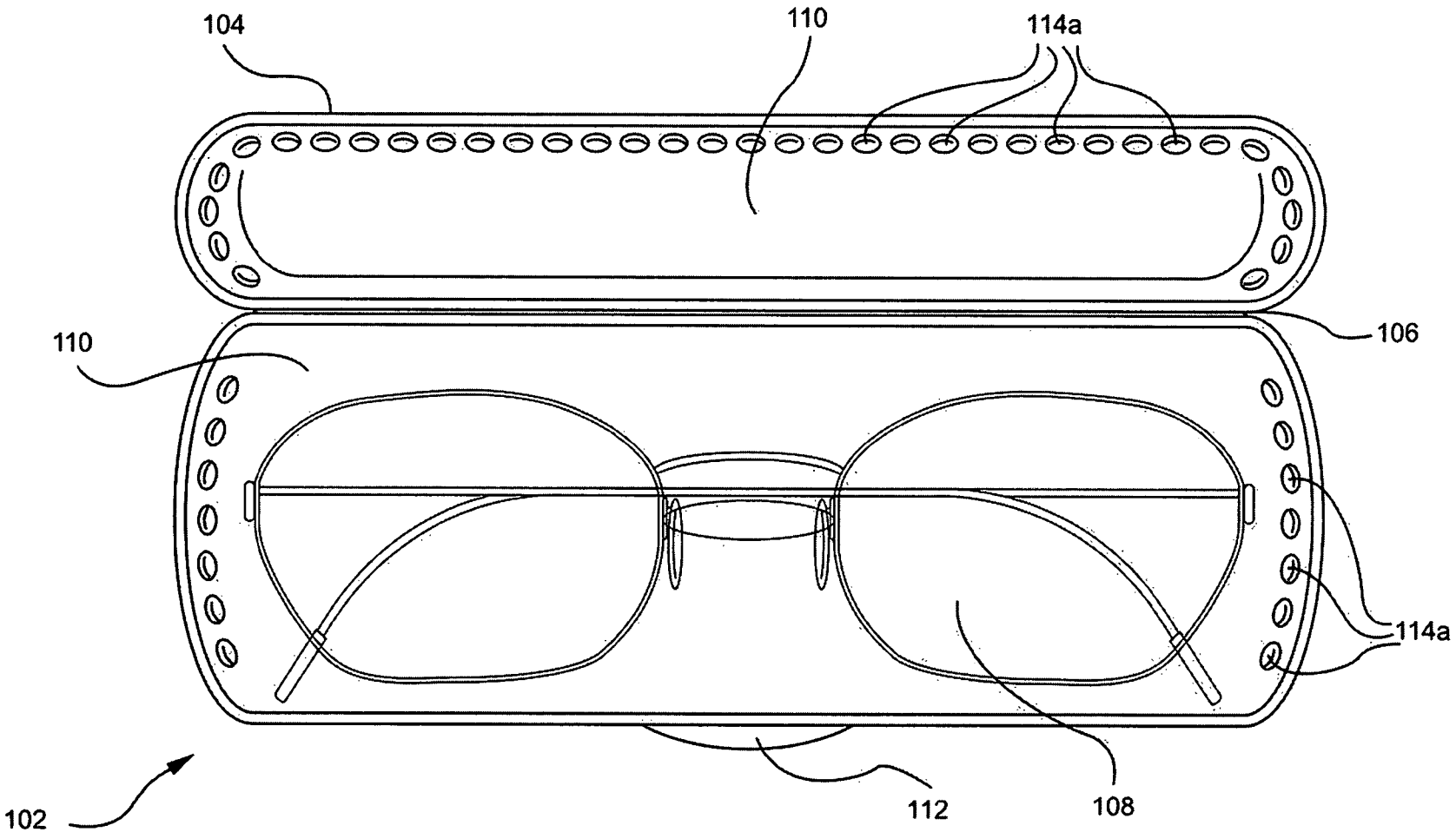
FIG. 1*a* is a top view of a lidded container with lid open retaining a pair of eyeglasses.

Referring to FIG. 1*a*, illustrated is a top view of a lidded embodiment of the invention, with container lid open, retaining a pair of eyeglasses. Container 102 has a lid 104 connected at hinge 106. In this illustration, eyeglasses 108 are retained within a compartment of container 102. Embodiments provide soft, lint-free material 110, such as felt or soft fiber cloth, within the interior of container 102 and lid 104, protecting the lenses of eyeglasses 108 from abrasive contact with the container interior. The invention further provides a transducer 112 and lights 114*a* (as illustrated, only some lights 114*a* are labeled for the sake of clarity). In operation, transducer 112 is operative to detect an action by the user (described in greater detail in reference to FIG. 3), operative to cause the opening of lid 104 and the illumination of lights 114*a* upon detecting the action, thereby presenting an open and illuminated compartment for the user to place or retrieve eyeglasses. Operation of the invention is described in more detail below.

Figure 1B:
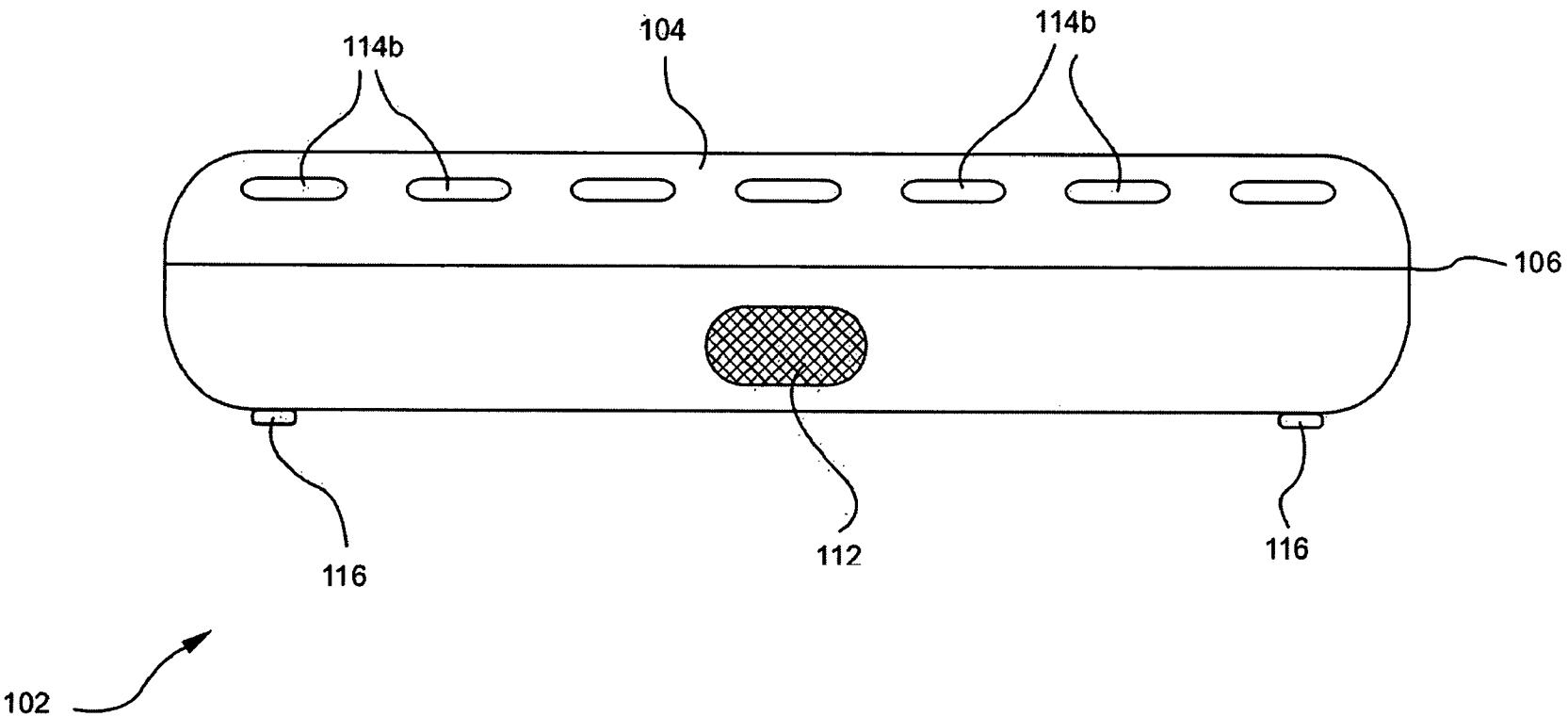
FIG. 1*b* is a front elevational view of a lidded container with lid shut.

Referring now to FIG. 1*b*, illustrated is a front elevational view of a lidded embodiment of the invention, showing container 102 with lid 104 closed. In this side view, feet 116 provide support for container 102 in a manner familiar to those of skill in arts related to the design of small appliances and similar household items. In the depicted embodiment, lights 114*b* are arranged along the side of container 102. In some embodiments, lights 114*b* are illuminated to a low level when lid 104 is closed, in order to enable a user to locate the container in a dark room. In some such embodiments, lights 114*b* may further serve to provide night light illumination. In some embodiments, lights 114*b* are simply apertures in container 102 providing illumination from lights 114*a* (FIG. 1*a*) in the compartment within container 102, while in other embodiments lights 114*b* are separate from the lights in the container's interior.

While an embodiment with a lid is described above and depicted in FIGS. 1*a* and 1*b*, it will be appreciated by those in the art that other configurations may be employed within the spirit of the present invention. For example, some embodiments may instead employ a drawer to retain the eyeglasses, while other embodiments may employ one or more vertically mounted doors instead of a lid to close the container. Some embodiments, as described in reference to FIGS. 2*a* and 2*b* below, do not have a lid or other means of closing and are instead lidless open containers. It is intended that the present invention encompass all such embodiments.

Figure 2A:
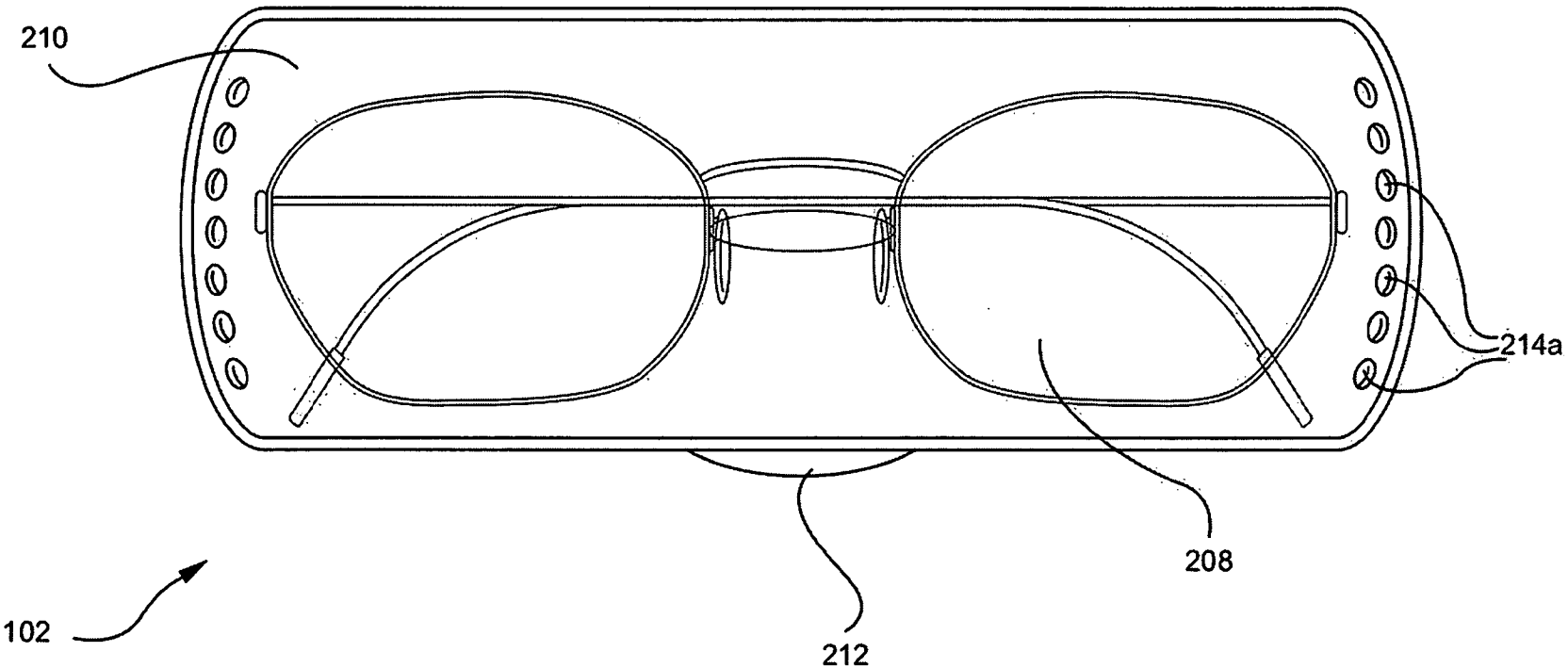
FIG. 2*a* is a top view of a lidless container with lid open retaining a pair of eyeglasses.

Referring now to FIG. 2*a*, depicting a lidless embodiment of the invention, illustrated is a top view of the container retaining a pair of eyeglasses. In this illustration, eyeglasses 208 are retained within a compartment of lidless container 202. Just as with the lidded container, embodiments provide soft, lint-free material 210, such as felt or soft fiber cloth, within the interior of container 202, protecting the lenses of eyeglasses 208 from abrasive contact with the container interior. Similar to the lidded container, the invention further provides a transducer 212 and lights 214*a* (as illustrated, only some lights 114*a* are labeled for the sake of clarity).

Figure 2B:
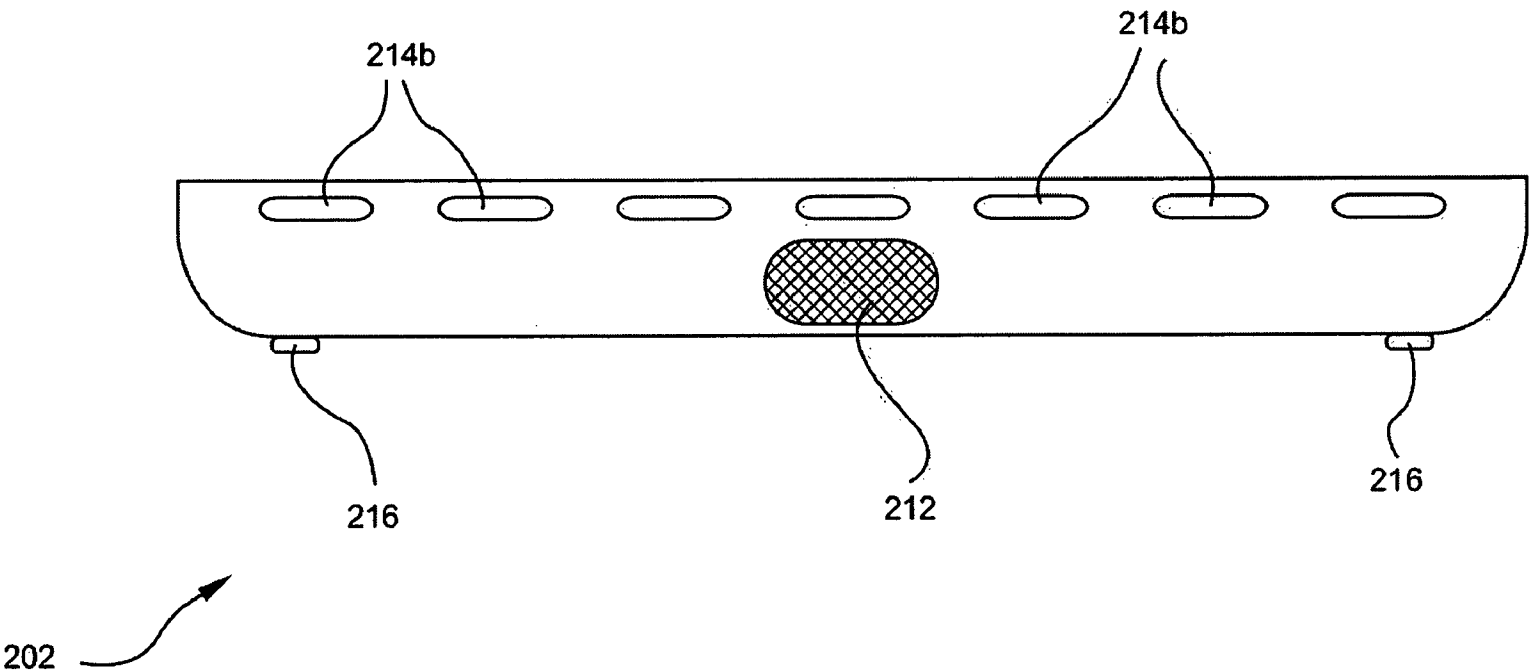
FIG. 2*b* is a front elevational view of a lidless container with lid shut.

Referring now to FIG. 2*b*, illustrating a front elevational view of container 202, feet 216 provide support for container 202. In the depicted embodiment, lights 214*b* are arranged along the side of container 202, the lights arranged and operating in a manner similar to those described in reference to FIGS. 1*a* and 1*b*.

Embodiments of the case comprising container 102 and lid 104 and lidless container 202 may be made of wood, plastic, sheet metal or various other materials familiar to those of skill in the art. In some embodiments of the lidded container, lid 104 comprises transparent material permitting inspection of container 102 while lid 104 is closed.

Furthermore, some embodiments may be mounted to a surface by any number of mounting means, such as hooks, screws, suction cups, brackets and the like, known to those in the art. For embodiments designed to rest on a surface such as furniture, it is preferred that the container resist sliding, and so such embodiments may be weighted and/or have feet 116, 216 comprised of material with relatively high coefficient of friction, such as rubber, as will be appreciated by those of skill in the art.

Lights 114, 214 may comprise any unit light source, including but not limited to fluorescent, incandescent and light emitting diode (LED), and combinations thereof. It will be appreciated by those in the art that the present invention is not limited to any particular form of light source, but rather is intended to encompass any form of light source now known or later discovered serving to provide the illumination required for the function of the invention.

Electrical power for the invention may be supplied by a source within container 102, 202 such as batteries, or by separate power source such as from alternating current from a wall source or direct current supplied by a separate transformer, or by a combination of interior and separate power sources. As will be clear to those in the art, the present invention is not limited to any particular kind of power source and instead encompasses any source and any form factor for the electrical power required for the container's operation. In embodiments in which lights 114*b*, 214*b* serve as a night light, it is preferred that electrical power be supplied from an outside source, such as wall current either directly or via transformer, in order to avoid consuming batteries for such purpose.

Turning to detailed discussion of the operation of the invention, a user causes the container to operate by performing an action that causes a signal to be generated by a transducer 112, 212. In motion activated embodiments, transducer 112, 212 is a motion detector and the action required to cause the container to operate is the user's reaching toward the container. In such embodiments, the transducer signal is generated when the user's hand reaches a designated proximity to container 102, 202. In some motion activated embodiments of the invention, the designated proximity at which the transducer signal is generated may be adjusted, a preferred proximity being 12 to 24 inches.

In voice activated embodiments, transducer 112, 212 is a microphone coupled to a speech recognition module and the action required to cause the container to operate is the user's voicing a specified utterance in the vicinity of container 102, 202. In such embodiments, the transducer signal is generated upon recognition by the speech recognition module of microphone input corresponding to the utterance. In some such embodiments of the invention, the utterance which is operative to open the container may be selected and the apparatus programmed to recognize such utterance by the user, the particulars of such programming being specific to the particular speech recognition apparatus employed in the particular embodiment.

As will be appreciated by those of skill in the art, the form of speech recognition practiced by voice activated embodiments of the invention may vary, from general speech recognition, whereby the apparatus is activated on detection of the specified utterance, regardless of the actual speaker, to speaker recognition, whereby the apparatus will open only on detection of an utterance by a specific speaker, to speaker/speech recognition, whereby activation occurs only on the voicing of a specified utterance by a specific speaker. It will be understood that the present invention is intended to encompass all such embodiments.

In any case, in lidded embodiments the signal from the transducer (whether motion or voice activated) is operative to cause a motor or other electromechanical device to open the lid 104 of the container, at the same time causing lights 114*a* to illuminate the interior of container 102. Upon opening, some lidded embodiments of the invention may produce an audible signal, such as a chime or music, alerting the user that the container is opened.

After thus opening, some lidded embodiments of the invention may simply remain open and illuminated for a designated period, after which time the lid closes automatically and illumination is extinguished. In some such embodiments, this period, which may be 20 to 30 seconds, is adjustable by the user according to the user's needs. Alternatively, some motion activated lidded embodiments of the invention may simply remain open and illuminated so long as proximity is detected, closing and extinguishing illumination when proximity is no longer detected, some such embodiments further adding a delay before closing after proximity is no longer detected, which delay may, in turn, be adjustable in some embodiments. In any case, it is preferable that closing of the container take place gently to avoid damage to eyeglasses or injury to the user. Further to provide security for personal objects retained in the container, some voice activated lidded embodiments may lock securely when closed, unlocking only when the specified utterance is detected.

In lidless embodiments, when the user causes the container to operate, a signal is generated by transducer 212, the signal operative to cause lights 214*a* to illuminate the interior of lidless container 202. Upon activation resulting from the transducer signal, some lidless embodiments of the invention may produce an audible signal, such as a chime or music, alerting the user that the container is opened.

After such activation, some lidless embodiments of the invention may simply remain illuminated for a designated period, after which time the illumination is extinguished. In some such embodiments, this period, which may be 20 to 30 seconds, is adjustable by the user according to the user's needs. Alternatively, some motion activated lidless embodiments of the invention may simply remain illuminated so long as proximity is detected, extinguishing illumination when proximity is no longer detected, some such embodiments further adding a delay before extinguishing illumination after proximity is no longer detected, which delay may, in turn, be adjustable in some embodiments.

Figure 3:
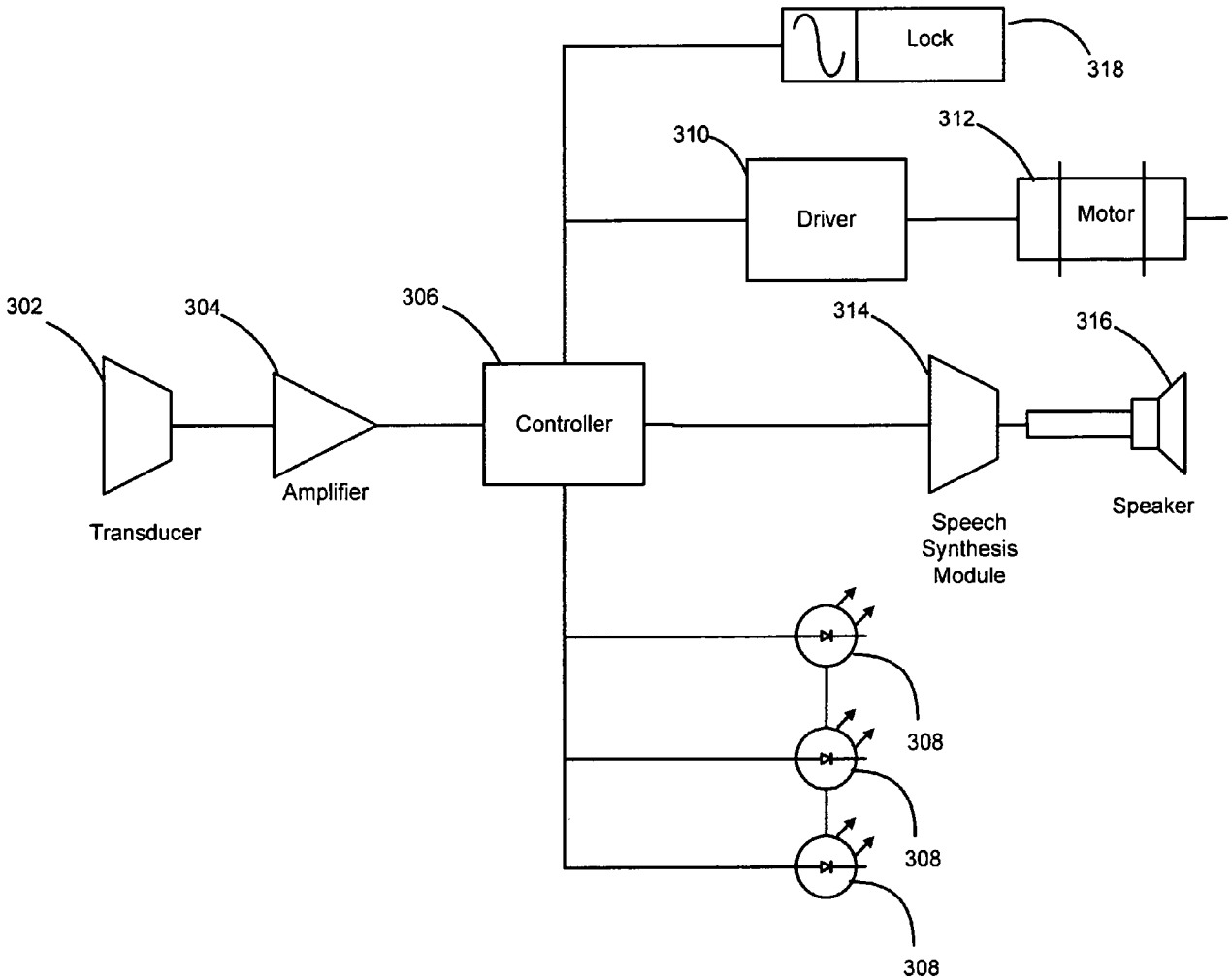
FIG. 3 is a functional diagram of electronics supporting an embodiment of the invention.

Turning now to control of the operation of the invention with reference to FIG. 3, illustrated is a functional diagram of control electronics for a lidded embodiment of the invention. As described above, the invention employs a transducer which generates a signal responsive to some action by the user. When the user's action has been detected by transducer 302, a signal is transmitted to amplifier 304. A signal generated by amplifier 304 responsive to the signal from transducer 302 causes controller 306 to illuminate lights for the container interior, such as LEDs 308. In lidded embodiments, the signal further causes controller 306 to activate driver 310 to drive motor 312 to open the compartment.

In some lidded embodiments, the container is locked when closed. In such embodiments, a signal from controller 306, generated in response to the signal from transducer 302, causes lock 318 to open. For such embodiments employing speech recognition, such locking functionality provides security for the object contained in the compartment, to which access can be obtained only by speaking the specified utterance. While FIG. 3 depicts an electromechanical locking device for lock 318, it will be appreciated by those of skill in the art that lock 318 may be any form of locking mechanism that may be directly or indirectly electronically actuated in response to detection of the specified utterance by control circuitry in the container.

In some embodiments, the signal from amplifier 304 may further cause controller 306 to cause the production of an auditory signal, such as, in the depicted embodiment, a synthesized voice produced by speech synthesis module 314, reproduced by speaker 316. In other embodiments providing auditory signals, various sounds may be produced by various other synthetic or transducive means, as will be well understood by those of skill in the art, to provide the user with a non-visual cue to locate the container.

As will be appreciated by those of skill in the art, the functional diagram set forth in FIG. 3 is intended to give a general idea of one embodiment of the control function for operation of a lidded embodiment of the invention and is not intended to be limiting in any way. Given the requirements of the invention, those of skill in the art may fabricate appropriate control electronics. Such control electronics may be of a functional design departing from that illustrated in FIG. 3 but still remaining within the scope of the present invention.

Some embodiments of the invention may provide a hygienic feature, whereby a tissue or other disposable hygienic surface is presented each time a pair of glasses is placed in the container. Such functionality is particularly desirable when the container is used by a number of different people in succession. This hygienic functionality may be employed in either a motion activated or a speech activated embodiment of the invention.

Figure 4:
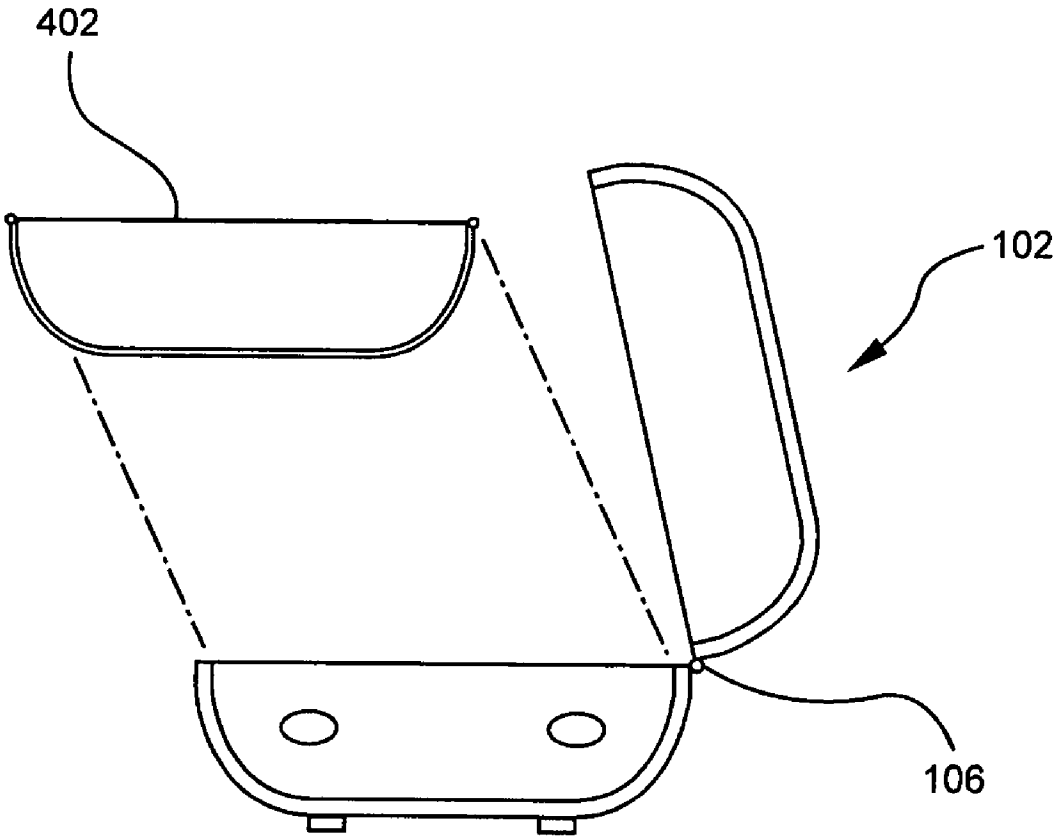
FIG. 4 is a drawing of the invention dispensing receiving an hygienic tissue.
Figure 5:
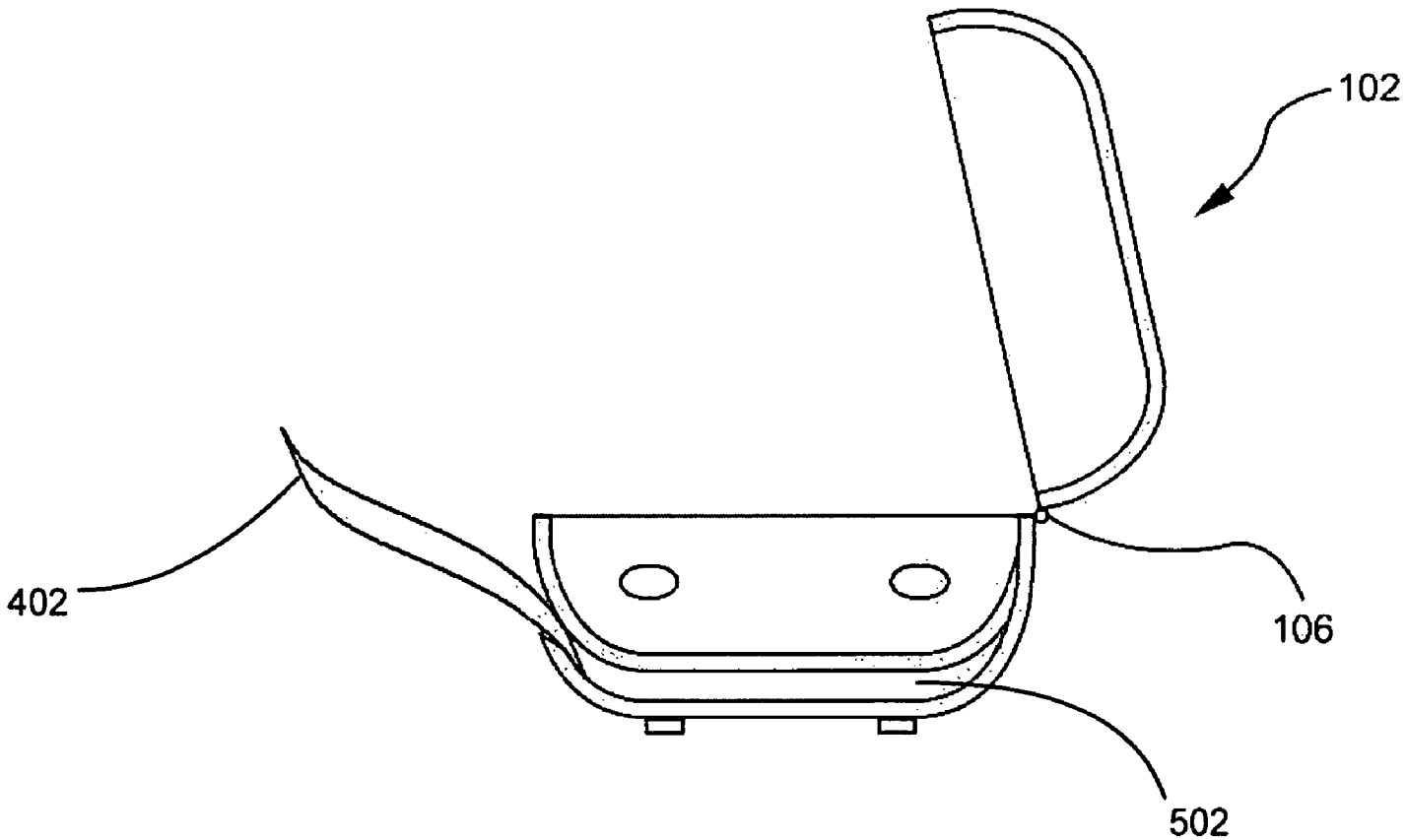
FIG. 5 is a drawing of the invention with an integral container for dispensing hygienic tissues.

Turning to FIG. 4, illustrated is an embodiment of the invention providing such hygienic functionality. Lidded container 102 is shown here in side view, opened at hinge 106. Vinyl or tissue liner 402 conforms to the interior of container 102 and is configured to be inserted therein prior to placement of a pair of glasses or other article in the container, thereby hygienically isolating the article from dust, oil, dirt or other debris which may have accumulated in the interior of container 102. Liner 402 may be specially fashioned to conform to the configuration of the interior of a particular embodiment. In the alternative, the interior of a particular embodiment may be configured to accept readily available tissue or other liners of generic dimensions, such as particular sizes of Kleenex® brand tissues. Liners may be disposable, as with the aforementioned tissues, or they may be reusable after suitable cleaning or other appropriate hygienic restoration. Furthermore, in some embodiments, dispensers of liners or tissues for the container may be affixed to or integral with container 102, such as dispensing container 502 illustrated in FIG. 5. As will be clear to those in the art, the present invention encompasses all such manners of affording hygienic functionality by providing appropriately sized and shaped hygienic tissues or other liners for the container. Furthermore, in some embodiments, the tissues or other liners may further serve the purpose of providing optical wipes for cleaning eyeglasses.

Enhancements to the foregoing embodiments of the container may provide additional utilities and functionalities. As stated earlier, some embodiments of the invention may provide illumination in the way of a nightlight when the container is closed. Additional functionalities may also be incorporated in the container. For example, the container may also provide an alarm clock, CD or MP3 player, AM/FM radio, reading light, and other typical bedside functionalities, alone or in combination, while still providing the functionality of retaining eyeglasses as described above. Furthermore, as will be appreciated by those of skill in the art, while the foregoing description has been directed specifically to the use of the invention to retain eyeglasses, the invention may in fact be used to retain any of a variety of objects, including wristwatches, jewelry and coins, so that they may be easily located by the user. Yet further, while the foregoing description has been directed principally to a single form factor of the invention, it will be appreciated that the container apparatus may be embodied in designs of widely varied shape (round, oval, square, octagonal, etc.), size and ornamental aspect and still be within the scope of the present invention.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. A container for retaining an object, comprising:
an interior in which an object may be placed;
a normally closed lid hingeably connected to the body;
a normally extinguished light source for illuminating the interior of the container; and
a transducer device operative, upon detection of a specified user action, to open the lid and illuminate the light source,
whereby a user may locate and access the interior of the body for placement and retrieval of the object.

2. A container according to claim 1, wherein the transducer device comprises a motion detector and the specified user action is motion by the user in the proximity of the container.

3. A container according to claim 1, wherein the transducer device comprises a speech recognition module and the specified user action is voicing of a specified utterance by the user in the proximity of the container.

4. A container according to claim 1, further comprising a source dispensing hygienic tissues, the tissues adapted for lining the container prior to the placement of an object.

5. A container according to claim 4, wherein the tissues are optical grade suitable for cleaning eyeglasses lenses.

6. A container for retaining an object for a user, comprising:
an interior in which an object may be placed;
a normally extinguished light source for illuminating the interior of the container; and
a speech recognition module, operative, upon detection of the voicing of a specified utterance by the user in the proximity of the container, to illuminate the light source,
whereby the user may locate and access the interior of the body for placement and retrieval of the object.

7. A container for retaining an object, comprising
an interior in which an object may be placed;
a normally extinguished light source for illuminating the interior of the container;
a source dispensing hygienic tissues, the tissues adapted for lining the container prior to the placement of an object; and
a transducer device operative, upon detection of a specified user action, to illuminate the light source,
whereby a user may locate and access the interior of the body for placement and retrieval of the object.

8. A container according to claim 7, wherein the tissues are optical grade suitable for cleaning eyeglasses cases.

9. A container for retaining an object, comprising:
an interior in which an object may be placed;
a normally closed, normally locked lid hingeably connected to the body;
a normally extinguished light source for illuminating the interior of the container; and
a transducer device operative, upon detection of a specified user action, to unlock and open the lid and illuminate the light source,
whereby a user may locate and access the interior of the body for placement and retrieval of the object.

* * * * *